US007052354B2

(12) United States Patent
Nakata

(10) Patent No.: US 7,052,354 B2
(45) Date of Patent: May 30, 2006

(54) METHOD FOR PRODUCING SPACER AND SPACER

(75) Inventor: Kohei Nakata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 207 days.

(21) Appl. No.: 10/630,679

(22) Filed: Jul. 31, 2003

(65) Prior Publication Data

US 2004/0070325 A1 Apr. 15, 2004

(30) Foreign Application Priority Data

Aug. 1, 2002 (JP) ..... 2002-224347
Aug. 1, 2002 (JP) ..... 2002-224348

(51) Int. Cl.
*H01J 9/00* (2006.01)
*H01J 9/24* (2006.01)

(52) U.S. Cl. ..... 445/24; 445/23

(58) Field of Classification Search ..... 445/24
See application file for complete search history.

(56) References Cited

U.S. PATENT DOCUMENTS 6,494,757 B1 * 12/2002 Yamazaki et al. ..... 445/24
6,517,399 B1 2/2003 Ito et al. ..... 445/24
2001/0034175 A1 10/2001 Miyazaki et al. ..... 445/25
2001/0041490 A1 11/2001 Nomura et al. ..... 445/24
2002/0004354 A1 1/2002 Kaneko et al. ..... 445/25

FOREIGN PATENT DOCUMENTS

JP 2000-164129 6/2000
JP 2000-311608 11/2000

* cited by examiner

*Primary Examiner*—Mariceli Santiago
*Assistant Examiner*—Elizabeth Rielley
(74) *Attorney, Agent, or Firm*—Fitzpatrick, Cella, Harper & Scinto

(57) ABSTRACT

In a method of producing a spacer for a display apparatus by heat drawing a base glass material having a cross section with different dimensions in a longitudinal and lateral directions and then cutting into a desired length, a base glass material in which a high-viscosity glass material is combined on both ends of a low-viscosity glass material is drawn within a temperature range in which both glass materials have different viscosities. Such method avoids a deformation of the spacer such as an expansion or a rounding at the longitudinal ends in the cross section of the spacer or a constriction in an intermediate portion in the longitudinal direction.

12 Claims, 10 Drawing Sheets

METHOD FOR PRODUCING SPACER AND SPACER

BACKGROUND OF THE INVENTION

1. Field of the Invention

The present invention relates to a method for producing a spacer and a spacer, which is adapted to be positioned between a pair of substrates on an electric or electronic device and to maintain a gap between such substrates.

2. Related Background Art

Recently, there is being developed a flat panel display in which electron-emitting elements of surface conduction type are arranged in a matrix array on a substrate and emitted electrons irradiate a phosphor material provided on another opposed substrate, so positioned as to hermetically seal the electron-emitting elements, thereby forming an image.

For producing a spacer for supporting substrates of such an electron beam apparatus in which an electron beam source is hermetically sealed between a pair of substrates, there is known a heat drawing method in which a base glass material of a rectangular cross section is advanced by a rotation of feed rollers so positioned as to pinch the base glass, while the advanced base glass is pinched between pull rollers and is pulled with a pull speed higher than a feeding speed of the feed rollers, and the base glass is softened by heating between the feed rollers and the pull rollers to achieve a drawing of the base glass by a speed difference between the feeding speed of the feed rollers and the pull speed of the pull rollers, thereby obtaining a drawn base glass material of a cross sectional shape similar to that of the base glass, and such drawn base glass is cut to obtain a slat-shaped spacer of a desired dimension (Japanese Patent Application Laid-open No. 2000-164129 etc.).

On the other hand, with respect to the spacer to be employed in such electron beam apparatus, there is pointed out a possibility that a part of the electrons emitted from the electron source collide with the spacer or ions formed by the emitted electrons stick to the spacer, thereby inducing a charge thereon. A charging of the spacer hinders an exact control of the trajectory of the electrons emitted from the electron source, thereby resulting in a drawback, for example, of a distortion in the displayed image.

In order to avoid such drawback, Japanese Patent Application Laid-open No. 2000-311608 discloses a technology of forming an irregular structure on the surface of the space, thereby suppressing a charging thereon. The Japanese Patent Application Laid-open No. 2000-311608 discloses, utilizing the aforementioned heat drawing method, a method of forming surface irregularities while executing the heat drawing, and a method of forming irregularities in advance on a base glass material and then heat drawing such base glass material.

In general, the drawing of a glass material is executed under heating in such a manner that the glass material has a viscosity within a range of $10^5$ to $10^{10}$ dPa·s.

Also in the prior methods explained in the foregoing, the drawing of the glass material is executed under heating in such a manner that the glass material has a viscosity within a range of $10^5$ to $10^{10}$ dPa·s, but in case the drawing is executed with a viscosity at a lower side, namely with a heating temperature at a higher side, both end portions of the obtained slat-shaped spacer in the longitudinal direction in the cross section tend to become rounded and expanded, as shown in FIG. 8. When the obtained slat-shaped spacer is placed on the substrate, in a position standing thereon and extending oblong along the substrate, because a contact surface of the spacer with the substrate is curved, such spacer is poor in stability and in an assembling property and is difficult to provide a sufficient supporting strength.

On the other hand, in case the drawing is executed with a viscosity at a higher side, namely with a heating temperature at a lower side, an intermediate portion of the obtained slat-shaped spacer tends to become constricted in the longitudinal direction in the cross section, as shown in FIG. 9. A spacer with such constriction cannot provide a desired strength, and, in case it is employed as a spacer positioned between a pair of substrates for example of a flat panel display, in which a space between the substrates is maintained at a reduced pressure, there may not be obtained a necessary resistance to the atmospheric pressure.

Also, in case the cross sectional shape of the spacer at the manufacture thereof is poorly controlled as explained above, the aforementioned irregularities for suppressing the charging cannot be obtained in a designed shape, whereby a desired charge suppressing effect cannot be obtained.

SUMMARY OF THE INVENTION

It is an object of the present invention, in producing a spacer of a cross sectional shape with different dimensions in the vertical and lateral directions by drawing a base glass material under heating to obtain a drawn base glass and then by cutting such drawn base glass into a desired length, to enable easy production of a spacer without expansion or constriction as explained in the foregoing.

It is another object of the present invention to enable production of a spacer, having surface irregularities for charge suppression etc., more easily and with an improved precision in shape.

According to the present invention, there is provided a method for producing a spacer by drawing a base glass material, having a cross sectional shape with different dimensions in vertical and lateral directions, under heating at a drawing temperature thereby obtaining a drawn base glass and then by cutting it into a desired length, the method being featured in that, in a longitudinal direction of a cross section of a base glass material, a high-viscosity glass material is combined in at least both end portions of a low-viscosity glass material to obtain a base glass material of an entire cross-sectional shape having different dimensions in vertical and lateral directions, and such base glass material is drawn under heating to a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

According to the present invention, there is also provided a spacer having a cross sectional shape with different dimensions in vertical and lateral directions, featured in that, in a longitudinal direction of a cross section of the spacer, a high-viscosity glass material is integrated in at least both end portions of a low-viscosity glass material to obtain a glass material of an entire cross-sectional shape having different dimensions in vertical and lateral directions, and such glass material shows a higher viscosity in the high-viscosity glass material than in the low-viscosity glass material when heated at a temperature at which both the low-viscosity glass material and the high-viscosity glass material have a viscosity within a range of $10^5$ to $10^{10}$ dPa·s.

According to the present invention, there is also provided a method for producing a spacer having irregularities on a surface thereof by drawing a base glass material, having a cross sectional shape with different dimensions in vertical and lateral directions and having plural grooves on an external surface along the longitudinal direction of the cross section, under heating at a drawing temperature and then by cutting into a desired length, the method being featured in that the base glass material has a composite structure constituted of a low-viscosity glass material positioned in an internal layer of the base glass material and a high-viscosity glass material provided in an area including at least an external surface along the longitudinal direction of the aforementioned cross section in a surface layer of the base glass material, the high-viscosity glass material at least includes a member having plural grooves on an external surface side, and the base glass material is drawn under heating at a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

According to the present invention, there is also provided a spacer having irregularities on a surface thereof, featured in that the spacer has a composite structure integrated by a low-viscosity glass material positioned in an internal layer of the spacer and a high-viscosity glass material provided in at least an area having the irregularities in an external surface of the spacer, and the glass material shows a higher viscosity in the high-viscosity glass material than in the low-viscosity glass material when heated at a temperature at which both the low-viscosity glass material and the high-viscosity glass material have a viscosity within a range of $10^5$ to $10^{10}$ dPa·s.

DETAILED DESCRIPTION OF THE PREFERRED EMBODIMENTS

Figure 1:
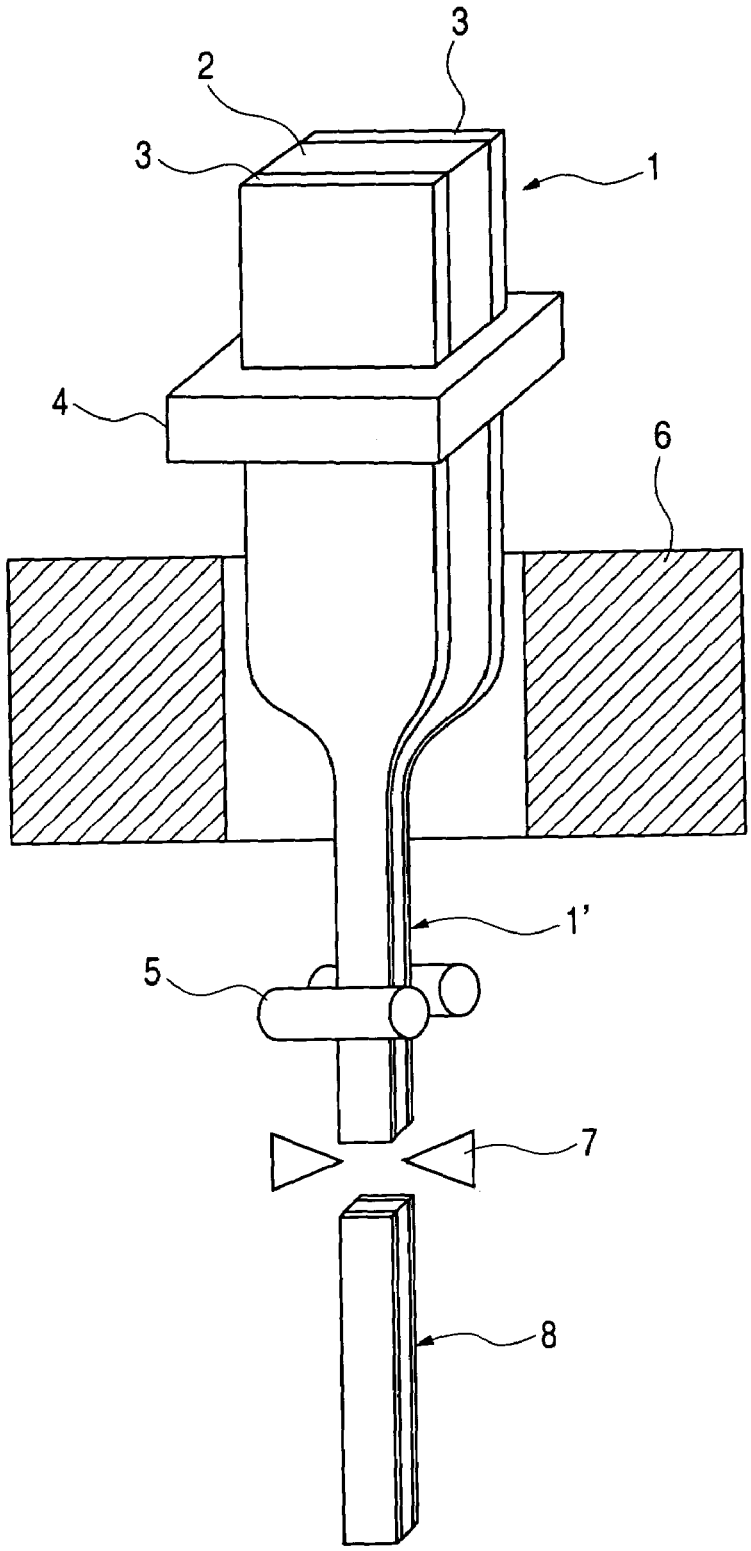
FIG. 1 is a schematic view showing a method for producing a spacer embodying the present invention.

The aforementioned expansion or constriction is considered to be generated by a fact that, in heating a base glass material of a cross sectional shape having different dimensions in the vertical and lateral directions, both end portions in the cross section in the longitudinal direction thereof are more easily heated than an intermediate portion. For example, in a base glass material of a rectangular cross section, let us define a surface along a longitudinal direction of the cross section as a longer surface, and a surface along a transversal direction of the cross section as a shorter surface. An intermediate portion in the longitudinal direction of the cross section is heated by the heat from the longer surface, while both end portions in the longitudinal direction of the cross section are heated by the heat from the longer surface and the shorter surface and are more easily heated than the intermediate portion. For this reason, in heating the base glass material so as to bring the entire cross section thereof in the longitudinal direction to a state having an easily drawable predetermined viscosity, it is estimated that the end portions are excessively heated to result in a lowered viscosity, thereby causing an expansion phenomenon. Also in case the temperature of heating is lowered in order to suppress such expansion phenomenon, the intermediate portion becomes heated insufficiently to result in a higher viscosity, thereby causing a stress concentration at the drawing operation and leading to a constriction.

The present invention has been made in consideration of the aforementioned cause of generation of the expansion and the constriction.

In a first embodiment of the present invention, there is provided a method for producing a spacer by drawing a base glass material, having a cross sectional shape with different dimensions in vertical and lateral directions, under heating to a drawing temperature and then by cutting into a desired length, the method being featured in that, in a longitudinal direction of a cross section of a base glass material, a high-viscosity glass material is combined in at least both end portions of a low-viscosity glass material to obtain a base glass material of an entire cross-sectional shape having different dimensions in vertical and lateral directions, and such base glass material is drawn under heating to a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

The first embodiment of the present invention also includes, as preferred embodiments:

covering, with the high-viscosity glass material, a surface at least in both end portions of the low-viscosity glass material in the longitudinal direction in the cross section of the base glass material;

covering, with the high-viscosity glass material, an entire surface of the low-viscosity glass material along the longitudinal direction in the cross section of the base glass material;

covering, with the high-viscosity glass material, an entire surface of the low-viscosity glass material along the longitudinal direction and the transversal direction in the cross section of the base glass material; and employing glass material of plural kinds as the high-viscosity glass material.

Also in a second embodiment of the present invention, there is provided a spacer having a cross sectional shape with different dimensions in vertical and lateral directions, featured in that:

in a longitudinal direction of a cross section of the spacer, a high-viscosity glass material is integrated in at least both end portions of a low-viscosity glass material to obtain a glass material of an entire cross-sectional shape having different dimensions in vertical and lateral directions, and that such glass material shows a higher viscosity in the high-viscosity glass material than in the low-viscosity glass material when heated to a temperature at which both the low-viscosity glass material and the high-viscosity glass material have a viscosity within a range of $10^5$ to $10^{10}$ dPa·s.

The second embodiment of the present invention also includes, as preferred embodiments:

that a surface of at least both end portions of the low-viscosity glass material, in the longitudinal direction in the cross section of the spacer, is covered with the high-viscosity glass material;

that an entire surface of the low-viscosity glass material, in the longitudinal direction in the cross section of the spacer, is covered with the high-viscosity glass material;

that an entire surface of the low-viscosity glass material, in the longitudinal direction and the transversal direction in the cross section of the spacer, is covered with the high-viscosity glass material; and that glass materials of plural kinds are employed as the high-viscosity glass material.

Also in a third embodiment of the present invention, there is also provided a method for producing a spacer having irregularities on a surface thereof by drawing a base glass material, having a cross sectional shape with different dimensions in vertical and lateral directions and having plural grooves on an external surface along the longitudinal direction of the cross section, under heating to a drawing temperature and then by cutting into a desired length, the method being featured in that the base glass material has a composite structure constituted of a low-viscosity glass material positioned in an internal layer of the base glass material and a high-viscosity glass material provided in an area including at least an external surface along the longitudinal direction of the aforementioned cross section in a surface layer of the base glass material, that the high-viscosity glass material at least includes a member having plural grooves on an external surface side, and that the base glass material is drawn under heating to a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

The third embodiment of the present invention also includes, as preferred embodiments:

that the low-viscosity glass material has a rectangular cross section and the high-viscosity glass material is applied on at least two surfaces of the low-viscosity glass material along longer sides of the cross section;

that the high-viscosity glass material applied to two surfaces of the low-viscosity glass material, along longer sides of the cross section, includes plural slat-shaped members and that the slat-shaped member has a width same as a pitch of the aforementioned plural grooves and includes two portions of different thicknesses respectively corresponding to a peak portion and a bottom portion of the groove;

that the high-viscosity glass material applied to two surfaces of the low-viscosity glass material, along longer sides of the cross section, has a resistivity within a range of $10^8$ to $10^{10}$ Ω·cm;

that the high-viscosity glass material is further applied to two surfaces of the low-viscosity glass material, along shorter sides of the cross section;

that the high-viscosity glass material applied to two surfaces of the low-viscosity glass material, along shorter sides of the cross section, has a resistivity within a range of $10^3$ to $10^4$ Ω·cm; and that glass materials of plural kinds are employed as the high-viscosity glass material.

Also in a fourth embodiment of the present invention, there is also provided a spacer having irregularities on a surface thereof, featured in that the spacer has a composite structure integrated by a low-viscosity glass material positioned in an internal layer of the spacer and a high-viscosity glass material provided in at least an area having the irregularities in an external surface of the spacer, and the glass material shows a higher viscosity in the high-viscosity glass material than in the low-viscosity glass material when heated to a temperature at which both the low-viscosity glass material and the high-viscosity glass material have a viscosity within a range of $10^5$ to $10^{10}$ dPa·s.

The fourth embodiment of the present invention also includes, as preferred embodiments:

that the low-viscosity glass material has a rectangular cross section and the high-viscosity glass material is integrated on at least two surfaces of the low-viscosity glass material along longer sides of the cross section;

that the high-viscosity glass material integrated with two surfaces of the low-viscosity glass material, along longer sides of the cross section, has a resistivity within a range of $10^8$ to $10^{10}$ Ω·cm;

that the high-viscosity glass material is further integrated with two surfaces of the low-viscosity glass material, along shorter sides of the cross section;

that the high-viscosity glass material integrated with two surfaces of the low-viscosity glass material, along shorter sides of the cross section, has a resistivity within a range of $10^3$ to $10^4$ Ω·cm; and that glass materials of plural kinds are employed as the high-viscosity glass material.

In the following, the aforementioned first and second embodiments of the present invention will be explained with specific examples.

Figure 2:
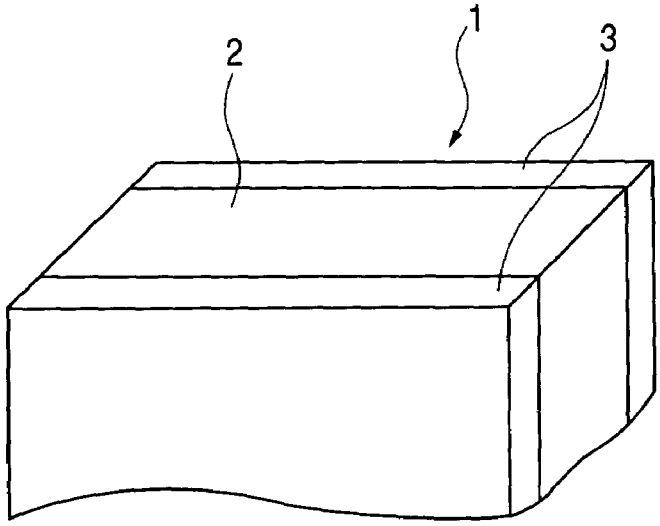
FIG. 2 is a partial magnified view of a base glass material shown in FIG. 1, in first and second embodiments.
Figure 3:
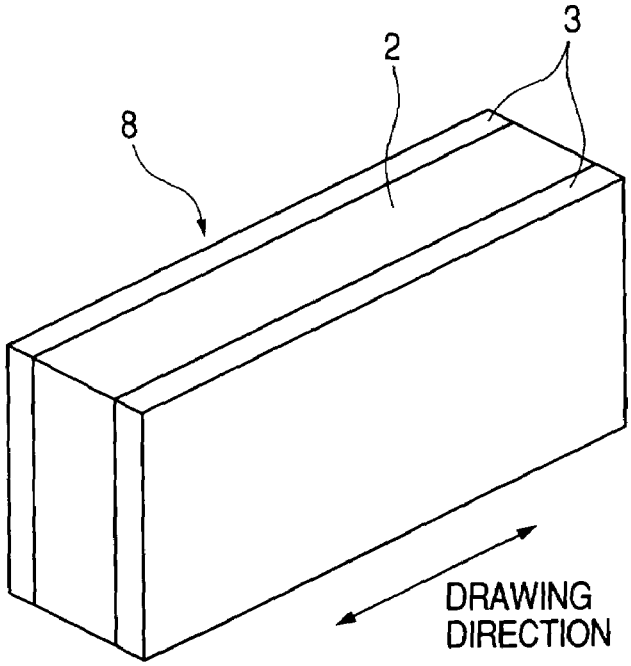
FIG. 3 is a magnified perspective view showing a spacer of first and second embodiments of the present invention.

FIG. 1 is a schematic view showing an example of a method for producing a spacer according to the embodiments, FIG. 2 is a partial magnified view of a base glass material shown in FIG. 1, and FIG. 3 is a magnified perspective view of a spacer of the present invention obtained by the method shown in FIG. 1.

Referring to FIG. 1, a base glass material 1 is formed, as illustrated in magnified manner in FIG. 2, by combining a low-viscosity glass material 2 of a rectangular cross section (perpendicular to a drawing direction of the base glass material 1) and high-viscosity glass materials 3 of a plate shape of a rectangular cross section, which respectively cover both longer surfaces (surfaces along the longitudinal direction of the cross section) to sandwich the low-viscosity glass material 2, thereby obtaining a rectangular cross section as a whole.

The base glass material 1 in the present example has a rectangular cross section, but the present invention is useful not only in the base glass material 1 of the rectangular cross section but also in a base glass material 1 of a cross sectional shape with different vertical and lateral dimensions, for example that of an oval or trapezoidal cross section, and is particularly effective in a base glass material 1 of a cross sectional shape in which a dimension in the longitudinal direction is 5 times or more of a dimension in the transversal direction, since the heated state tends to become different between an intermediate portion and end portions in the longitudinal direction of the cross section. Also the rectangular shape used in the present specification includes not only a shape having four right-angled corners but also a shape in which corners are beveled or rounded.

The combination of the low-viscosity glass material 2 and the high-viscosity glass material 3 may in a mutually pressed state, a mutually fitted state or a mutually adhered state. In the present example, the low-viscosity glass material 2 and the high-viscosity glass material 3 are combined in a mutually pressed state by tightening of the periphery of the base glass material 1 with a mechanical chuck 4.

A glass material constituting the low-viscosity glass material 2 and the high-viscosity glass material 3 may be selected, for example, from elementary glass, oxide glass, fluoride glass, chloride glass, sulfide glass etc. according to the purpose. In consideration of a working property of these, there is preferred oxide glass (such as silicate glass, phosphate glass, borate glass or borosilicate glass).

In the example shown in FIG. 1, the base glass material 1, formed by a combination of the low-viscosity glass material 2 and the high-viscosity glass material 3, is tightened and supported by the mechanical chuck 4, then a lower part is drawn under heating with a heater 6, and a lower part of a drawn base glass material 1' is pinched between pull rollers 5. In this state, the pull rollers are rotated while the mechanical chuck 4 is gradually lowered to pull the drawn base glass material 1' with a pull speed larger than a descending speed of the mechanical chuck 4, and the base glass material 1 is heated and softened to a drawing temperature by heating with the heater 6 in a position between the mechanical chuck 4 and the pull rollers 5. Thus, because of a difference between the descending speed of the mechanical chuck 4 and the pull speed of the pull rollers 5, the base glass material 1, softened by heating to the drawing temperature, is drawn with an integration of the low-viscosity glass material 2 and the high-viscosity glass material 3, thereby continuously forming a drawn base glass material 1' of a cross sectional shape approximately similar to that of the base glass material 1. The drawn base glass material 1', after passing the pull rollers 5, is cut in a cooled and solidified state with a cutter 7 to obtain a plate-shaped or pillar-shaped spacer 8 of a desired dimension (cf. FIG. 3).

The drawing of base glass material 1 is executed under heating to a drawing temperature at which both the low-viscosity glass material 2 and the high-viscosity glass material 3 have a viscosity within a range of $10^5$ to $10^{10}$ dPa·s and the high-viscosity glass material has a viscosity higher than that of the low-viscosity glass material. The drawing of the base glass material 1 becomes difficult in case the low-viscosity glass material 2 and the high-viscosity glass material 3 have a viscosity outside the range of $10^5$ to $10^{10}$ dPa·s. A specific drawing temperature varies depending on the materials constituting the low-viscosity glass material 2 and the high-viscosity glass material 3, but is generally within a range of about 500 to 1000° C.

The drawing under heating to a drawing temperature at which both the low-viscosity glass material 2 and the high-viscosity glass material 3 have a viscosity within a range of $10^5$ to $10^{10}$ dPa·s and the high-viscosity glass material has a viscosity higher than that of the low-viscosity glass material can be achieved by employing, as the low-viscosity glass material and the high-viscosity glass material of the present invention, glass materials showing a higher viscosity in the high-viscosity glass material than in the low-viscosity glass material, upon heating to a temperature at which both the low-viscosity glass material and the high-viscosity glass material have a viscosity within a range of $10^5$ to $10^{10}$ dPa·s. The viscosity of the low-viscosity glass material and the high-viscosity glass material can be adjusted by regulating components thereof and their amounts. For example in oxide glass, it is possible to decrease (or increase) the viscosity in a high-temperature region by increasing (or decreasing) a content of an alkali oxide, boron oxide or lead oxide contained therein, and also to increase (or decrease) the viscosity in the high-temperature region by increasing (or decreasing) a content of silicon oxide, aluminum oxide, titanium oxide, zirconium oxide etc. It is also possible to combine a regulation of the aforementioned components or amounts thereof, and a regulation of the heating temperature of the low-viscosity glass material 2 and the high-viscosity glass material 3. The regulation of the heating temperature can be achieved, for example, by heating a central portion of the low-viscosity glass material 2 by infrared irradiation through a lens or a concave mirror focused to such central portion, thereby bringing the low-viscosity glass material 2 to a temperature higher than that of the high-viscosity glass material 3.

Such method allows to obtain a spacer 8 without expansion or constriction as illustrated in magnified manner in FIG. 3. This is attributable to a fact that, because the high-viscosity glass material 3 covering the longer surfaces of the low-viscosity glass material 2 has a higher viscosity than that of the low-viscosity glass material 2, the expansion phenomenon can be suppressed by the covering high-viscosity glass material 3 even in case the viscosity of the low-viscosity glass material 2 of the end portions in the longitudinal direction of the cross section of the base glass material 1 becomes excessively low. Therefore, such expansion phenomenon can be avoided even under heating to a drawing temperature at which a base glass material 1 solely composed of the low-viscosity glass material 2 generates an expansion on both end portions in the longitudinal direction of the cross section, whereby a spacer 8 without expansion or constriction can be obtained.

Ordinarily, the spacer 8 has a thickness of about 0.05 to 0.5 mm, and, for such thickness, the high-viscosity glass material 3 preferably has a thickness of 0.5 to 5 μm. More specifically, a thickness of the base glass material 1 and thicknesses of the low-viscosity glass material 2 and the high-viscosity glass material 3 are preferably so selected to remain in the aforementioned ranges after the drawing. The drawing becomes difficult in case the high-viscosity glass material 3 in the base glass material 1 has an excessively large thickness, while the aforementioned effect for suppressing the expansion becomes difficult to obtain in case of an excessively small thickness. The low-viscosity glass material 2 and the high-viscosity glass material 3 preferably have a difference in the viscosity, at the drawing temperature, of 0.1 dPa·s or larger, in order to facilitate the expansion suppressing effect.

Figure 4:
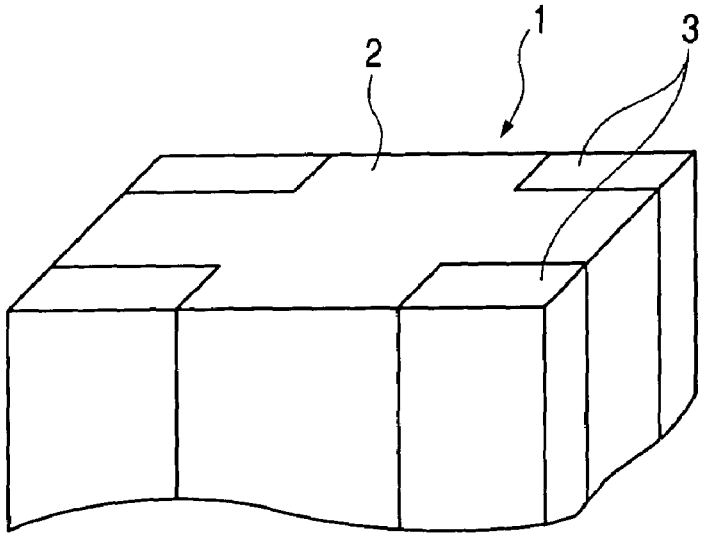
FIG. 4 is a partial magnified view showing another example of the base glass material of the first and second embodiments.
Figure 5:
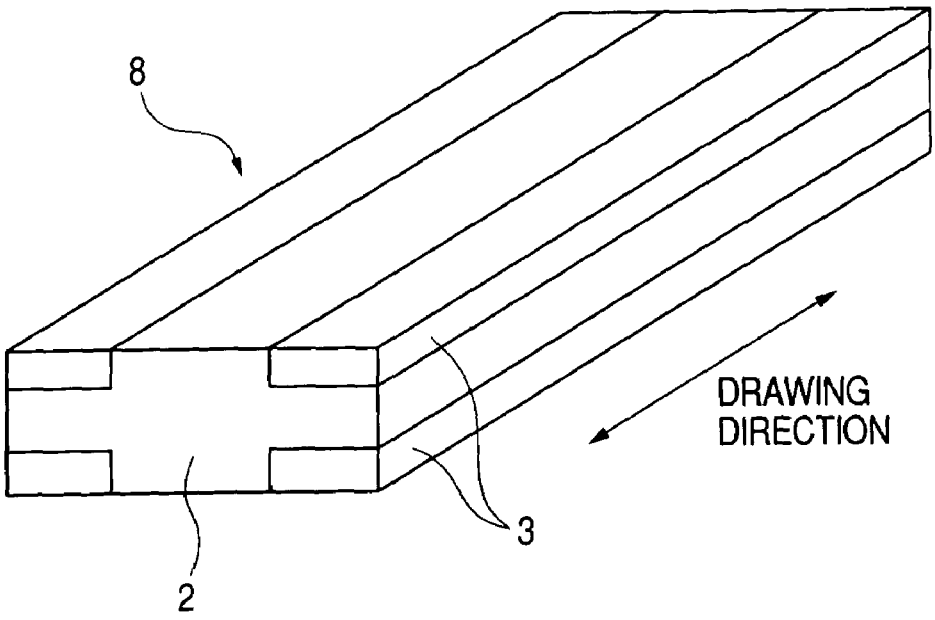
FIG. 5 is a perspective view showing a spacer of the present invention, obtained from the base glass material shown in FIG. 4.

FIG. 4 is a partial magnified view showing another example of the base glass material, and FIG. 5 is a perspective view showing a spacer of the present invention obtained from the base glass material shown in FIG. 4, wherein components same as those in FIGS. 1 to 3 are represented by same numbers.

The base glass material 1 shown in FIGS. 1 and 2 is formed by sandwiching the low-viscosity glass material 2 by applying the high-viscosity glass material 3 on the mutually opposed entire longer surfaces of the low-viscosity glass material 2. In contrast, in the base glass material 1 of the present example, the high-viscosity glass material 3 sandwiches only both end portions of the low-viscosity glass material 2 in the longitudinal direction of the base glass material 1, in such a manner as to form a rectangular cross section as a whole. In this manner it is rendered possible to preferentially protect, by the high-viscosity glass material 3, the easily heated end portions in the longitudinal direction of the cross section. The spacer 8 obtained from such base glass material 1 has the high-viscosity glass material 3 at four corners.

In the base glass material 1 shown in FIG. 1, it is also possible to apply a high-viscosity glass material (not shown) further on both shorter surfaces of the low-viscosity glass material 2 to form a rectangular cross section as a whole. In this manner, the obtained spacer 8 is covered by the high-viscosity glass material 3 also on the shorter surfaces, whereby the shorter surface can be made flat more easily. In such case it is also possible to constitute the high-viscosity glass material 3 on the longer surfaces of the low-viscosity glass material 2 and the high-viscosity glass material (not shown) on the shorter surfaces by glass materials different in the kind and/or amount of the components, thereby attaining a delicate control for prevention of expansion.

Figure 6:
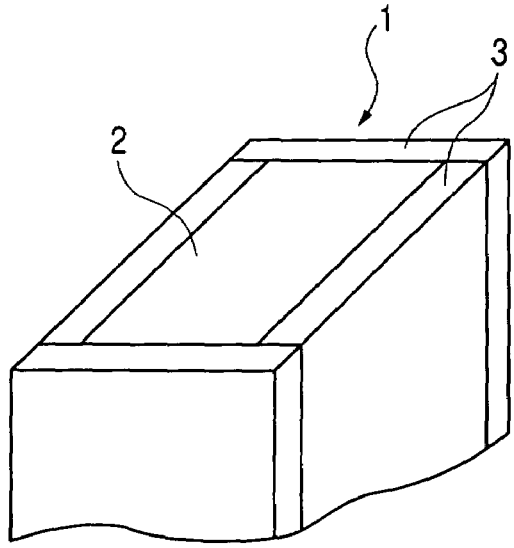
FIG. 6 is a partial magnified view showing still another example of the base glass material of the first and second embodiments.
Figure 7:
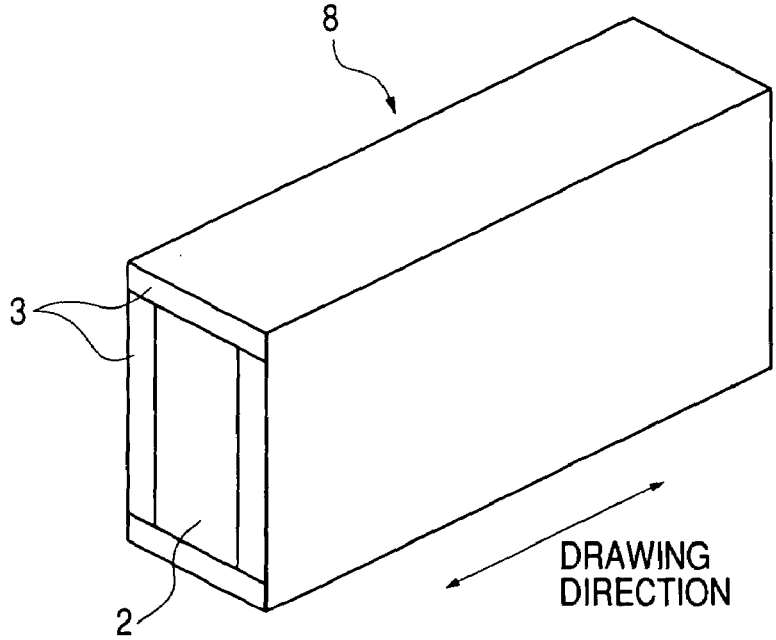
FIG. 7 is a perspective view showing a spacer of the present invention, obtained from the base glass material shown in FIG. 6.

FIG. 6 is a partial magnified view showing another example of the base glass material, and FIG. 7 is a perspective view showing a spacer of the present invention obtained from the base glass material shown in FIG. 6, wherein components same as those in FIGS. 1 to 3 are represented by same numbers.

In the base glass material 1 of the present example, all the longer surfaces and the shorter surfaces of the low-viscosity glass material 2 are covered with the high-viscosity glass material 3. In this manner, the obtained spacer 8 is covered with the high-viscosity glass material 3 also on the shorter surfaces, whereby the shorter surfaces can be made flat more easily and a combination of the low-viscosity glass material 2 and the high-viscosity glass material 3 can be facilitated in comparison with a case where only the end portions of the low-viscosity glass material are covered by the high-viscosity glass material 3. Also in this example, it is possible to constitute the high-viscosity glass material 3 on the longer surfaces of the low-viscosity glass material 2 and the high-viscosity glass material 3 on the shorter surfaces by glass materials different in the kind and/or amount of the components, thereby attaining a delicate control for prevention of expansion.

In the following, the aforementioned third and fourth embodiments of the present invention will be explained with specific examples.

Figure 10:
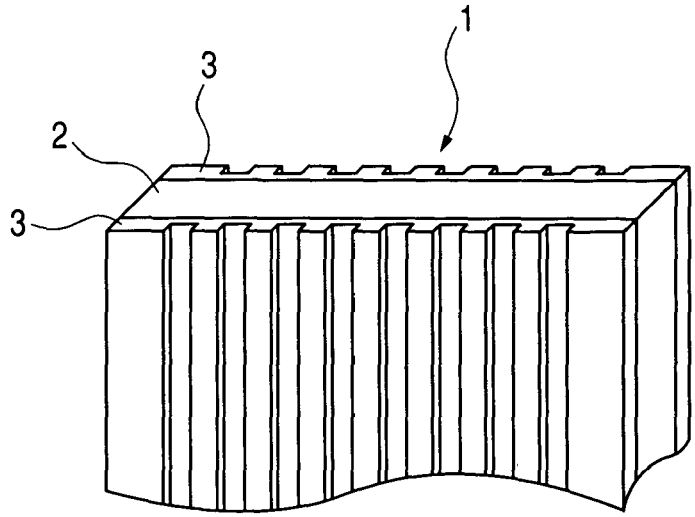
FIG. 10 is a partial magnified view of a base glass material shown in FIG. 1, in third and fourth embodiments.
Figure 11:
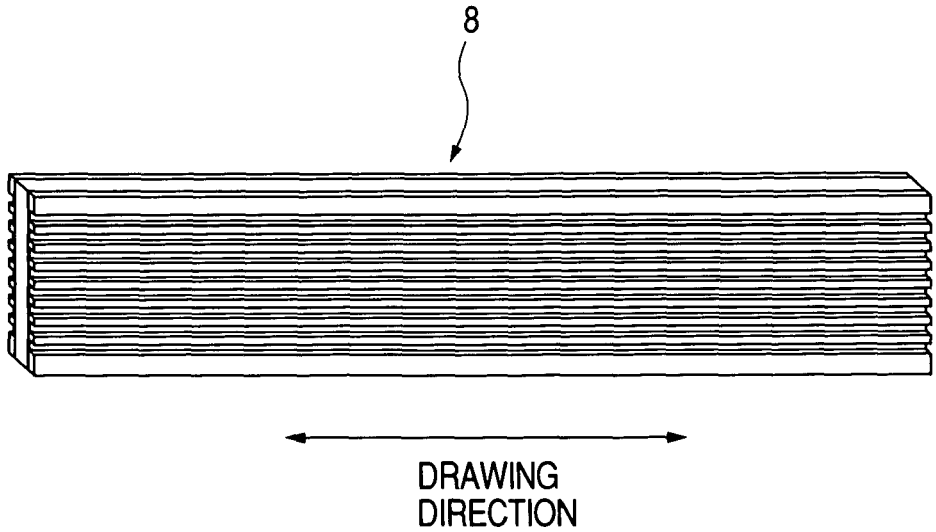
FIG. 11 is a magnified perspective view showing a spacer of third and fourth embodiments.

FIG. 1 is a schematic view showing an example of a method for producing a spacer according to the embodiments, FIG. 10 is a partial magnified view of a base glass material shown in FIG. 1, and FIG. 11 is a magnified perspective view of a spacer of the present invention obtained by the method shown in FIG. 1.

Referring to FIG. 1, a base glass material 1 is formed, as illustrated in magnified manner in FIG. 10, by combining a low-viscosity glass material 2 of a rectangular cross section (perpendicular to a drawing direction of the base glass material 1) and high-viscosity glass materials 3 of a plate shape, which respectively cover both longer surfaces (surfaces along the longitudinal direction of the cross section) to sandwich the low-viscosity glass material 2, thereby obtaining a substantially rectangular cross section as a whole.

The high-viscosity glass material 3 constituting the base glass material 1 is provided with plural grooves along the drawing direction, on an external surface, namely a surface opposite to a surface applied to the low-viscosity glass material 2 as shown in FIGS. 10 and 11, though such plural grooves are omitted in FIG. 1 for the purpose of simplicity.

The base glass material 1 in the present example has an approximately rectangular cross section, but the present invention is useful not only in the base glass material 1 of such cross section but also in a base glass material 1 of a cross sectional shape with different vertical and lateral dimensions, for example that of an approximately oval cross section or an approximately trapezoidal cross section, and is particularly effective in a base glass material 1 of a cross sectional shape in which a dimension in the longitudinal direction is 5 times or more of a dimension in the transversal direction, since the heated state tends to become different between an intermediate portion and end portions in the longitudinal direction of the cross section. Also the approximately rectangular shape used in the present specification includes not only a shape having four right-angled corners but also a shape in which corners are beveled or rounded, and the shape is called approximate in consideration of the presence of grooves. However, in order to obtain a spacer capable of stably supporting the substrates and to obtain a cross sectional shape, including the shape of the grooves, matching the desired design with satisfactory control.

The combination of the low-viscosity glass material 2 and the high-viscosity glass material 3 may in a mutually pressed state, a mutually fitted state or a mutually adhered state. In the present example, the low-viscosity glass material 2 and the high-viscosity glass material 3 are combined in a mutually pressed state by tightening of the periphery of the base glass material 1 with a mechanical chuck 4.

A glass material constituting the low-viscosity glass material 2 and the high-viscosity glass material 3 may be selected, for example, from elementary glass, oxide glass, fluoride glass, chloride glass, sulfide glass etc. according to the purpose. In consideration of a working property of these, there is preferred oxide glass (such as silicate glass, phosphate glass, borate glass or borosilicate glass).

In the example shown in FIG. 1, the base glass material 1, formed by a combination of the low-viscosity glass material 2 and the high-viscosity glass material 3, is tightened and supported by the mechanical chuck 4, then a lower part is drawn under heating with a heater 6, and a lower part of a drawn base glass material 1' is pinched between pull rollers 5. In this state, the pull rollers are rotated while the mechanical chuck 4 is gradually lowered to pull the drawn base glass material 1' with a pull speed larger than a descending speed of the mechanical chuck 4, and the base glass material 1 is heated and softened to a drawing temperature by heating with the heater 6 in a position between the mechanical chuck 4 and the pull rollers 5. Thus, because of a difference between the descending speed of the mechanical chuck 4 and the pull speed of the pull rollers 5, the base glass material 1, softened by heating to the drawing temperature, is drawn with an integration of the low-viscosity glass material 2 and the high-viscosity glass material 3, thereby continuously forming a drawn base glass material 1' of a cross sectional shape approximately similar to that of the base glass material 1. The drawn base glass material 1', after passing the pull rollers 5, is cut in a cooled and solidified state with a cutter 7 to obtain a plate-shaped or pillar-shaped spacer 8 of a desired dimension (cf. FIG. 11).

Figure 14:
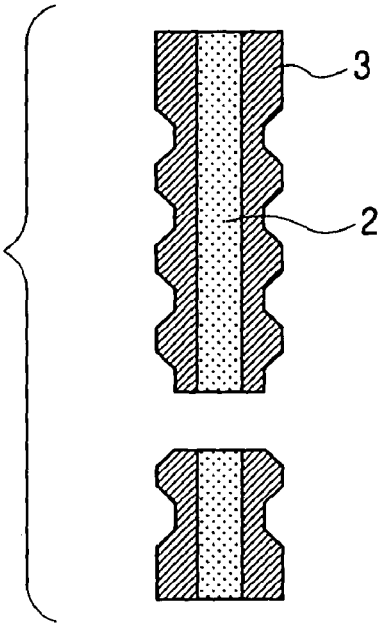
FIG. 14 is a cross-sectional view of a configuration in which a groove provided in a high-viscosity glass material has a trapezoidal shape.

A cross-sectional shape of a groove to be provided on the high-viscosity glass material 2 constituting the base glass material 1 can be for example rectangular, trapezoidal or semicircular, and may be suitably determined according such a design as to minimize an incident angle of the electrons entering the surface of the spacer 8 when the completed spacer 8 formed by drawing is positioned between the substrates, as described in Japanese Patent Application Laid-open No. 2000-311608. FIG. 10 shows grooves with a rectangular cross section while FIG. 14 shows grooves with a trapezoidal cross section. Grooves with a trapezoidal cross section as shown in FIG. 14 are preferred since the incident angle of the electrons entering the surface of the spacer can be made smaller.

Dimensions, such as a width, a depth and a pitch, of the grooves are dependent on a level of drawing operation and are suitably determined according to a design of a completed state. The groove in the present invention need not necessarily be continuous in the drawing direction of the base glass material but may be interrupted in the course thereof, but a continuous groove in the drawing direction is preferred in consideration of ease of working operation.

The drawing of base glass material 1 is executed under heating to a drawing temperature at which both the low-viscosity glass material 2 and the high-viscosity glass material 3 have a viscosity within a range of $10^5$ to $10^{10}$ dPa·s and the high-viscosity glass material has a viscosity higher than that of the low-viscosity glass material. The drawing of the base glass material 1 becomes difficult in case the low-viscosity glass material 2 and the high-viscosity glass material 3 have a viscosity outside the range of $10^5$ to $10^{10}$ dPa·s. A specific drawing temperature varies depending on the materials constituting the low-viscosity glass material 2 and the high-viscosity glass material 3, but is generally within a range of about 500 to 1000° C.

The drawing under heating to a drawing temperature at which both the low-viscosity glass material 2 and the high-viscosity glass material 3 have a viscosity within a range of $10^5$ to $10^{10}$ dPa·s and the high-viscosity glass material has a viscosity higher than that of the low-viscosity glass material can be achieved by employing, as the low-viscosity glass material and the high-viscosity glass material of the present invention, glass materials showing a higher viscosity in the high-viscosity glass material than in the low-viscosity glass material, upon heating to a temperature at which both the low-viscosity glass material and the high-viscosity glass material have a viscosity within a range of $10^5$ to $10^{10}$ dPa·s. The viscosity of the low-viscosity glass material and the high-viscosity glass material can be adjusted by regulating components thereof and their amounts. For example in oxide glass, it is possible to decrease (or increase) the viscosity in a high-temperature region by increasing (or decreasing) a content of an alkali oxide, boron oxide or lead oxide contained therein, and also to increase (or decrease) the viscosity in the high-temperature region by increasing (or decreasing) a content of silicon oxide, aluminum oxide, titanium oxide, zirconium oxide etc. It is also possible to combine a regulation of the aforementioned components or amounts thereof, and a regulation of the heating temperature of the low-viscosity glass material 2 and the high-viscosity glass material 3. The regulation of the heating temperature can be achieved, for example, by heating a central portion of the low-viscosity glass material 2 by infrared irradiation through a lens or a concave mirror focused to such central portion, thereby bringing the low-viscosity glass material 2 to a temperature higher than that of the high-viscosity glass material 3.

Such method allows to obtain a spacer 8 without expansion or constriction as illustrated in FIG. 11. This is attributable to a fact that, because the high-viscosity glass material 3 covering the longer surfaces of the low-viscosity glass material 2 has a higher viscosity than that of the low-viscosity glass material 2, the expansion phenomenon can be suppressed by the covering high-viscosity glass material 3 even in case the viscosity of the low-viscosity glass material 2 of the end portions in the longitudinal direction of the cross section of the base glass material 1 becomes excessively low. Therefore, such expansion phenomenon can be avoided even under heating to a drawing temperature at which a base glass material 1 solely composed of the low-viscosity glass material 2 generates an expansion on both end portions in the longitudinal direction of the cross section, whereby a spacer 8 without expansion or constriction can be obtained.

Also, since the grooves are to be formed only on one surface of the high-viscosity glass material, it is possible to achieve a simpler configuration of a manufacturing equipment and a simpler and shorter process. Also the use of the low-viscosity glass material and the high-viscosity glass material increases a freedom of selection of the materials, and it is rendered possible to give emphasis to strength and thermal expansion coefficient in selecting the low-viscosity glass material (in consideration a thermal stress in relation to the substrate) and to give emphasis to a charge suppressing effect in selecting the high-viscosity glass material.

Ordinarily, the spacer 8 has a thickness of about 0.05 to 0.5 mm, and, for such thickness, the high-viscosity glass material 3 preferably has a thickness of 0.5 to 5 μm. More specifically, a thickness of the base glass material 1 and thicknesses of the low-viscosity glass material 2 and the high-viscosity glass material 3 are preferably so selected to remain in the aforementioned ranges after the drawing. The drawing becomes difficult in case the high-viscosity glass material 3 in the base glass material 1 has an excessively large thickness, while the aforementioned effect for suppressing the expansion becomes difficult to obtain in case of an excessively small thickness. The low-viscosity glass material 2 and the high-viscosity glass material 3 preferably have a difference in the viscosity, at the drawing temperature, of 0.1 dPa·s or larger, in order to facilitate the expansion suppressing effect. In the present specification, a thickness of the high-viscosity glass material having a groove means a maximum thickness corresponding to a peak portion of the groove.

Figure 15:
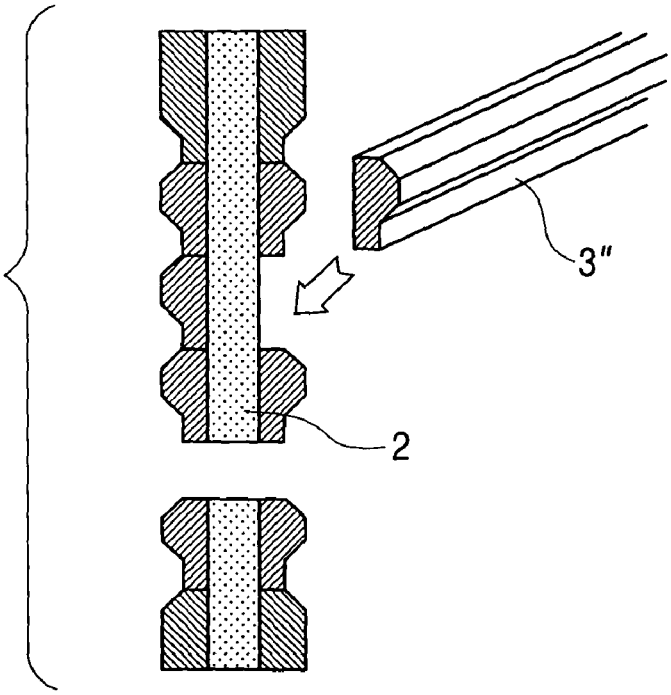
FIG. 15 is a conceptual view showing a configuration in the third and fourth embodiments, in which a high-viscosity glass material is formed by plural slat-shaped members.

For forming a member having plural grooves along the drawing direction on an external surface as the high-viscosity glass material, the grooves may be formed on a single plate-shaped high-viscosity glass material as explained in the foregoing, but it is also preferred to constitute the high-viscosity glass material from plural members including plural slat-shaped members. For this purpose, there is employed a slat-shaped member having a width same as the pitch of the aforementioned plural grooves and having portions of two different thicknesses respectively corresponding to a peak portion and a bottom portion of the groove. FIG. 15 is a conceptual view showing a configuration in which the high-viscosity glass material is constituted by plural members including such plural slat-shaped members. In FIG. 15, a numeral 3" indicates a slat-shaped member. In the present embodiment, there are prepared plural slat-shaped members 3" of a same shape which are so positioned as to cover a surface on a longer side of the cross section of the low-viscosity glass material 2, thereby constituting the high-viscosity glass material.

The slat-shaped member may be formed with a shape of a pitch, according to the shape of the groove, for example of a rectangular or trapezoidal cross section, to be formed on the high-viscosity glass material.

Such configuration of constituting the high-viscosity glass material with the plural slat-shaped members allows to further reduce the cost, since the preparation of members of a single shape is simpler in manufacture than a groove formation on a plate-shaped member.

The high-viscosity glass materials, applied to the two surfaces on the longer sides of the cross section of the low-viscosity glass material having a rectangular cross section, preferably has a resistivity within a range of $10^8$ to $10^{10}$ Ω·cm, in order that the resistance is high enough to present an excessive current flow between the substrates and low enough to adequately dissipate the charge.

Figure 16:
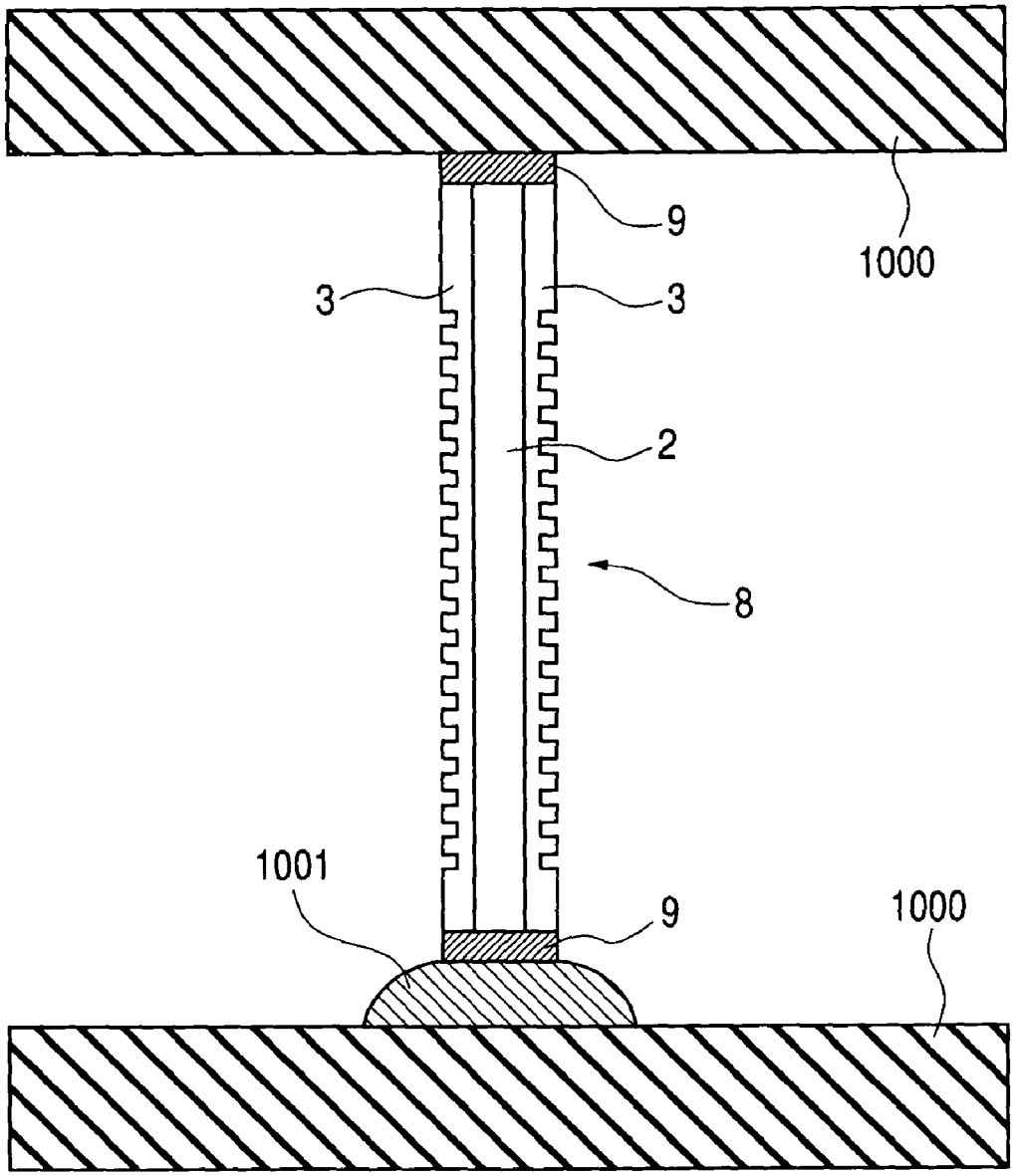
FIG. 16 is a conceptual cross-sectional view showing a state in which a spacer embodying the present invention is so positioned as to support substrates.
Figure 17:
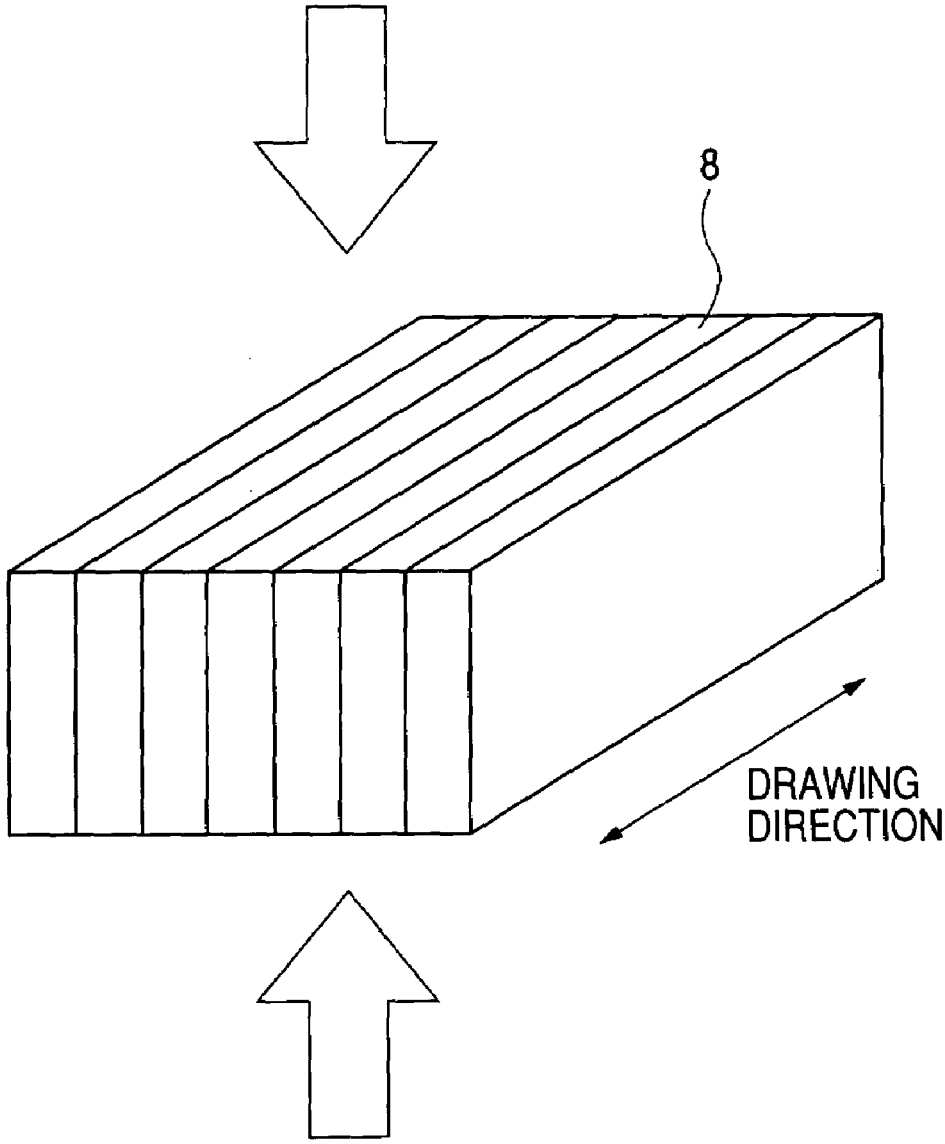
FIG. 17 is a conceptual view showing a step of forming a low-resistance film on a surface, to be adjoined to a substrate, of a spacer embodying the present invention.

Also a satisfactory stability in shape of the spacer provides another effect, which will be explained with reference to FIGS. 16 and 17. FIG. 16 is a schematic cross-sectional view showing a state where a spacer is so positioned as to support substrates, and FIG. 17 is a schematic view showing a process for forming a low-resistance film on a surface of the spacer to be adjoined with the substrate. In FIG. 16 there are shown a low-resistance film 9, a substrate 1000 and a wiring 1001 provided on the substrate.

In order to suppress the charging of the spacer, it is preferred, not only to provide the spacer 8 with irregularities thereby preventing entry or dissipation of the charge from an exposed surface, but also to form, as shown in FIG. 16, a low-resistance film 9 on a surface of the spacer 8 to be adjoined with the substrate 1000 or the wiring 1001 formed thereon.

There can be conceived various methods for forming such low-resistance film 9, but a method as shown in FIG. 17 can be employed for forming a satisfactory low-resistance film 9 on a plurality of spacers. More specifically, in this method, a large number of spacers are bundled so as to expose surfaces to be adjoined to the substrate, and a film of a low-resistance substance such as a metal is formed on such exposed portion for example by a sputtering method.

Figure 8:
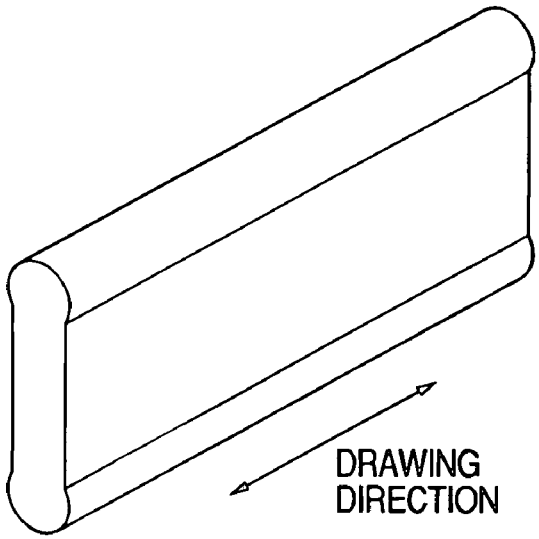
FIG. 8 PRIOR ART
FIG. 8 is a schematic view showing a state of generation of an expansion.
Figure 9:
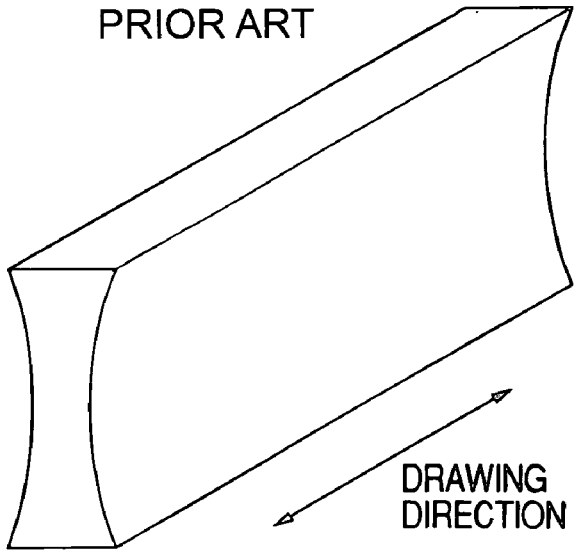
FIG. 9 PRIOR ART
FIG. 9 is a schematic view showing a state of generation of a constriction.

However, in case spacers of poor stability in shape, for example having a distorted shape as shown in FIG. 8 or 9, are bundled, gaps are generated between the spacers and a film forming operation thereon results in a deposition of the film-forming substance in portions other than the surface to be adjoined, whereby the desired formation of the low-resistance film 9 becomes impossible.

The spacers 8 of satisfactory stability in shape formed by the method of the present invention allows to avoid such drawback at the formation of the low-resistance film 9, thereby providing a satisfactory low-resistance film 9.

Figure 12:
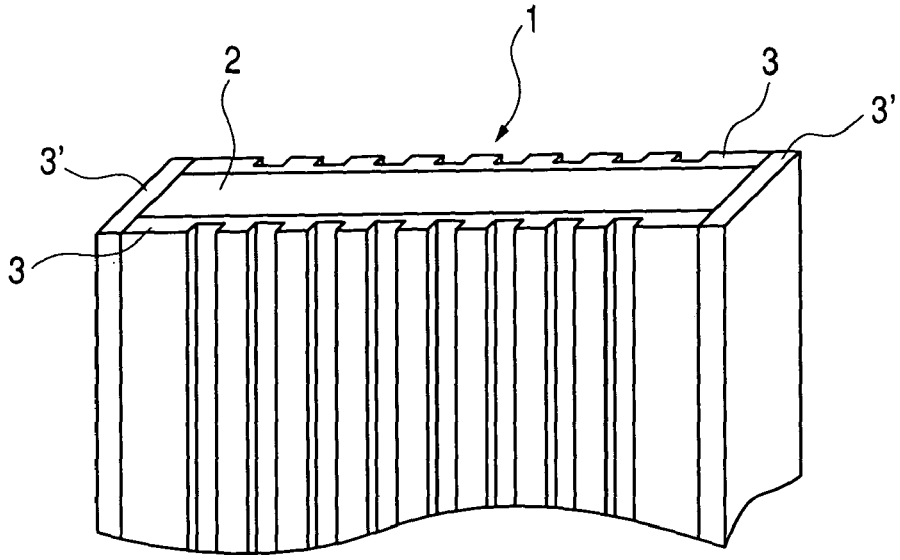
FIG. 12 is a partial magnified view showing another example of the base glass material of the third and fourth embodiments.
Figure 13:
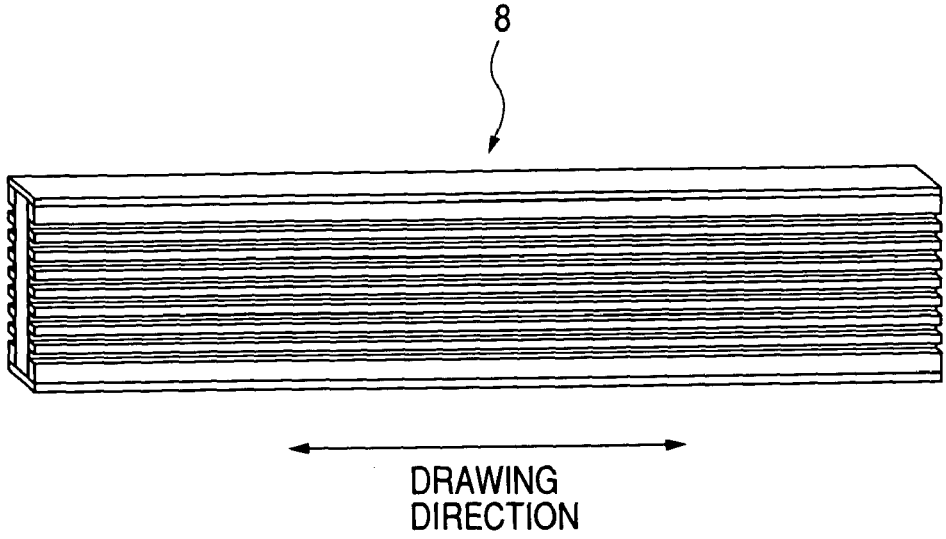
FIG. 13 is a perspective view showing a spacer embodying the present invention, obtained from the base glass material shown in FIG. 12.

FIG. 12 is a partial magnified view showing another example of the base glass material, and FIG. 13 is a magnified perspective view of a spacer of the present invention obtained from the base glass material shown in FIG. 12. Components same as those in FIGS. 1, 10 and 11 are represented by same numbers. A numeral 3' indicates a high-viscosity glass material applied to a shorter side in the cross section of a low-viscosity glass material 2 of a rectangular cross section.

In the base glass material 1 of the present example, a high-viscosity glass material 3' is applied also on shorter sides in the cross section of the low-viscosity glass material 2 having a rectangular cross section. In this manner, the obtained spacer 8 is covered with the high-viscosity glass material also on the shorter surfaces, whereby the shorter surfaces can be made flat more easily. Also in this example, it is possible to constitute the high-viscosity glass material 3 on the longer surfaces of the low-viscosity glass material 2 and the high-viscosity glass material 3' on the shorter surfaces of the cross section by glass materials different in the kind and/or amount of the components, thereby attaining a delicate control for prevention of expansion.

Also in the configuration shown in FIG. 12, by selecting the resistivity of the high-viscosity glass material 3', applied to the shorter sides in the cross section of the low-viscosity glass material, within a range of $10^3$ to $10^4$ Ω·cm, it may also be utilized as a low-resistance film 9 explained in the foregoing in relation to FIG. 16.

EXAMPLE 1

A spacer 8 was prepared by drawing a heated base glass material 1, employing a mechanical chuck 4 and pull rollers 5 as shown in FIG. 1.

The base glass material 1 had a configuration as shown in FIG. 2, formed with a low-viscosity glass material 2 having a rectangular cross section of 4×48 mm and by applying a high-viscosity glass material 3 of a thickness of 1 mm and a width of 48 mm on each of the surfaces constituting longer sides in the cross section of the low-viscosity glass material 2 and had an entire cross section S1 of 288 $mm^2$ (6×48 mm). There were employed a low-viscosity glass material showing a viscosity of $10^{6.5}$ dPa·s at a heated temperature of 800° C. for drawing, and a high-viscosity glass material showing a viscosity of $10^{7.6}$ dPa·s at a heated temperature of 800° C. for drawing.

The base glass material 1 was advanced with a speed V1=5 mm/min by lowering the mechanical chuck 4, then was heat drawn by heating at about 800° C. by a heater 6 and pulling at a speed V2=4500 mm/min by pulling rollers 5 positioned close to the heater 6, and was finally cut into a length of 1000 mm with a cutter 7. The obtained spacer 8 had a cross section S2 of 0.32 $mm^2$ (0.2×1.6 mm), in which the aforementioned partial constriction or expansion was not observed.

EXAMPLE 2

A spacer was prepared in the same manner as in the example 1, except that there were employed a low-viscosity glass material showing a viscosity of $10^{6.5}$ dPa·s at a heated temperature of 800° C. for drawing, and a high-viscosity glass material showing a viscosity of $10^{7.0}$ dPa·s at a heated temperature of 800° C. for drawing.

The obtained spacer did not show a partial constriction or a partial expansion as in the example 1.

COMPARATIVE EXAMPLE 1

A spacer was prepared in the same manner as in the example 1, except that there were employed a low-viscosity glass material showing a viscosity of $10^7$ dPa·s at a heated temperature of 800° C. for drawing, and a high-viscosity glass material showing a viscosity of $10^{7.005}$ dPa·s at a heated temperature of 800° C. for drawing.

The obtained spacer showed an expansion entirely and had a rounded shape.

EXAMPLE 3

A spacer 8 was prepared by drawing a heated base glass material 1, employing a mechanical chuck 4 and pull rollers 5 as shown in FIG. 1.

The base glass material 1 had a configuration as shown in FIG. 6, formed with a low-viscosity glass material 2 having a rectangular cross section of 4×46 mm and by applying a high-viscosity glass material 3 of a thickness of 1 mm and a width of 46 mm on each of the surfaces constituting longer sides in the cross section of the low-viscosity glass material 2 and a high-viscosity glass material 3 of a thickness of 1 mm and a width of 6 mm on each of the surfaces constituting shorter sides in the cross section of the low-viscosity glass material 2, and had an entire cross section S1 of 288 $mm^2$ (6×48 mm). There were employed a low-viscosity glass material showing a viscosity of $10^{6.0}$ dPa·s at a heated temperature of 800° C. for drawing, and a high-viscosity glass material showing a viscosity of $10^{7.6}$ dPa·s at a heated temperature of 800° C. for drawing.

The base glass material 1 was advanced with a speed V1=5 mm/min by lowering the mechanical chuck 4, then was heat drawn by heating at about 800° C. by a heater 6 and pulling at a speed V2=4500 mm/min by pulling rollers 5 positioned close to the heater 6, and was finally cut into a length of 1000 mm with a cutter 7. The obtained spacer 8 had a cross section S2 of 0.32 $mm^2$ (0.2×1.6 mm), in which the aforementioned partial constriction or expansion was not observed, and, in particular, the flatness of the shorter sides in the cross section was superior to that of the spacer of the example 1.

EXAMPLE 4

A spacer was prepared in the same manner as in the example 3, except that there were employed a low-viscosity glass material showing a viscosity of $10^{6.5}$ dPa·s at a heated temperature of 800° C. for drawing, and a high-viscosity glass material showing a viscosity of $10^{7.0}$ dPa·s at a heated temperature of 800° C. for drawing.

The obtained spacer did not show a partial constriction or a partial expansion as in the example 3, and was superior in the flatness of the shorter sides in the cross section to the spacer of the example 1.

COMPARATIVE EXAMPLE 2

A spacer was prepared in the same manner as in the example 3, except that there were employed a low-viscosity glass material showing a viscosity of $10^7$ dPa·s at a heated temperature of 800° C. for drawing, and a high-viscosity glass material showing a viscosity of $10^{7.005}$ dPa·s at a heated temperature of 800° C. for drawing.

The obtained spacer showed an expansion entirely and had a rounded shape.

EXAMPLE 5

A spacer 8 was prepared by drawing a heated base glass material 1, employing a mechanical chuck 4 and pull rollers 5 as shown in FIG. 1.

The base glass material 1 had a configuration as shown in FIG. 10, formed with a low-viscosity glass material 2 having a rectangular cross section of 4×48 mm and by applying a high-viscosity glass material 3 of a maximum thickness of 1 mm and a width of 48 mm on each of the surfaces constituting longer sides in the cross section of the low-viscosity glass material 2, and had a cross section of about 288 $mm^2$ in a circumscribed rectangle on the entire cross section (circumscribed rectangle of 6×48 mm). Grooves of the high-viscosity glass material 3 were prepared with a rectangular cross section as shown in FIG. 10, with a depth of 0.3 mm, a width of 0.3 mm and a pitch of 0.9 mm. There were employed a low-viscosity glass material showing a viscosity of $10^{6.0}$ dPa·s at a heated temperature of 800° C. for drawing, and a high-viscosity glass material showing a resistivity of $10^9$ Ω·cm and a viscosity of $10^{7.6}$ dPa·s at a heated temperature of 800° C. for drawing.

The base glass material 1 was advanced with a speed V1=5 mm/min by lowering the mechanical chuck 4, then was heat drawn by heating at about 800° C. by a heater 6 and pulling at a speed V2=4500 mm/min by pulling rollers 5 positioned close to the heater 6, and was finally cut into a length of 1000 mm with a cutter 7. The obtained spacer 8 had a cross section S2 of 0.32 $mm^2$ (0.2×1.6 mm), in which the aforementioned partial constriction or expansion was not observed. The grooves had a rectangular cross section and were obtained in regular forms with a depth of 10 μm, a width of 10 μm and a pitch of 30 μm.

Also a part of the high-viscosity glass material 3 had a sheet resistance of $10^{12}$ Ω/□.

EXAMPLE 6

A spacer was prepared in the same manner as in the example 5, except that there were employed a low-viscosity glass material showing a viscosity of $10^{6.5}$ dPa·s at a heated temperature of 800° C. for drawing, and a high-viscosity glass material showing a resistivity of $10^9$ Ω·cm and a viscosity of $10^{7.0}$ dPa·s at a heated temperature of 800° C. for drawing.

This example provided a spacer of a satisfactory quality as in the example 5.

COMPARATIVE EXAMPLE 3

A spacer was prepared in the same manner as in the example 5, except that the entire base glass material was composed of a glass material showing a viscosity of $10^7$ dPa·s at a heated temperature of 800° C. for drawing.

The obtained spacer showed an expansion entirely and had a rounded shape, and also the grooves were not obtained in a designed shape.

EXAMPLE 7

A spacer was prepared in the same manner as in the example 5, except that the periodical stripe-shaped grooves on the high-viscosity glass material in the example 5 were formed by arranging plural slat-shaped members 3" as shown in FIG. 15.

Each slat-shaped member 3" had an entire width of 0.9 mm, in which a portion of a maximum thickness had a width of 0.6 mm and a portion of a minimum thickness had a width of 0.3 mm, with a maximum thickness of 1 mm and a minimum thickness of 0.7 mm.

This example also provided a spacer of a satisfactory quality as in the example 5.

EXAMPLE 8

A spacer 8 was prepared by drawing a heated base glass material 1, employing a mechanical chuck 4 and pull rollers 5 as shown in FIG. 1.

The base glass material 1 had a configuration as shown in FIG. 12, formed with a low-viscosity glass material 2 having a rectangular cross section of 4×46 mm and by applying a high-viscosity glass material 3 of a maximum thickness of 1 mm and a width of 46 mm on each of the surfaces constituting longer sides in the cross section of the low-viscosity glass material 2 and a high-viscosity glass material 3' of a thickness of 1 mm and a width of 6 mm on each of the surfaces constituting shorter sides in the cross section of the low-viscosity glass material 2, and had a cross section of about 288 $mm^2$ in a circumscribed rectangle on the entire cross section (circumscribed rectangle of 6×48 mm). Grooves of the high-viscosity glass material 3 were prepared with a rectangular cross section, with a depth of 0.3 mm, a width of 0.3 mm and a pitch of 0.9 mm. There were employed a low-viscosity glass material showing a viscosity of $10^{6.0}$ dPa·s at a heated temperature of 800° C. for drawing, and a high-viscosity glass material showing a resistivity of $10^9$ Ω·cm and a viscosity of $10^{7.6}$ dPa·s at a heated temperature of 800° C. for drawing.

The base glass material 1 was advanced with a speed V1=5 mm/min by lowering the mechanical chuck 4, then was heat drawn by heating at about 800° C. by a heater 6 and pulling at a speed V2=4500 mm/min by pulling rollers 5 positioned close to the heater 6, and was finally cut into a length of 1000 mm with a cutter 7. The obtained spacer 8 had a cross section S2 of 0.32 $mm^2$ (0.2×1.6 mm), in which the aforementioned partial constriction or expansion was not observed, and, in particular, the flatness of the shorter sides in the cross section was superior to that of the spacer of the example 5. The grooves had a rectangular cross section and were obtained in regular forms with a depth of 10 μm, a width of 10 μm and a pitch of 30 μm.

Also a part of the high-viscosity glass material 3 had a sheet resistance of $10^{12}$ Ω/□.

EXAMPLE 9

In this example, a low resistance film was formed on each of the spacers prepared in the examples 5 to 8, by forming a Ti film of a thickness of 10 nm and a Pt film of a thickness of 200 nm in succession by sputtering, utilizing a method explained in relation to FIG. 17.

As a result, the film-forming materials were not deposited on the surfaces of the longer sides of the cross section of the spacer 8, and there was obtained a desired low resistance film of a sheet resistance $10^3$ Ω/□.

EXAMPLE 10

A spacer was prepared in the same manner as in the example 8, except that there was employed a high-viscosity glass material 3', applied to the surfaces of the shorter sides in the cross section of the low-viscosity glass material, having a resistivity of $10^4$ Ω·cm and showing a viscosity of $10^{7.6}$ dPa·s at a heated temperature of 800° C. for drawing.

In the obtained spacer, a part of the high-viscosity glass material 3' had a sheet resistance of $10^3$ Ω/□ and functioned sufficiently as a low resistance film.

As explained in the foregoing, the present invention enables to easily produce a spacer which does not show a constriction in shape and is stable in the strength, and, in producing a plate-shaped spacer with a rectangular cross section, allows to obtain a spacer capable of preventing an expansion on lateral surfaces around the shorter sides in the cross section and of easily realizing a stable installed state.

Also the present invention enables to produce a spacer having surfacial irregularities for suppressing a charge, with an improved precision of the shape and with an easier manner.

It is also made possible to prepare a satisfactory low resistance film in a desired state, without deposition in an unnecessary portion.

What is claimed is:

1. A method for producing a spacer by drawing a base glass material, having a cross sectional shape with different dimensions in vertical and lateral directions, under heating to a drawing temperature, and then by cutting into a desired length, wherein:

in a longitudinal direction of a cross section of the base glass material, a high-viscosity glass material is combined in at least both end portions with a low viscosity glass material to obtain an entire cross-sectional shape having different dimensions in vertical and lateral directions, and said base glass material is drawn under heating at a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

2. A producing method according to claim 1, wherein surfaces in at least both end portions of the low-viscosity glass material, in the longitudinal direction of the cross section of the base glass material, are covered with the high-viscosity glass material.

3. A producing method according to claim 1, wherein entire surfaces of the low-viscosity glass material, along the longitudinal direction of the cross section of the base glass material, are covered with the high-viscosity glass material.

4. A producing method according to claim 1, wherein entire surfaces of the low-viscosity glass material, along the longitudinal direction and shorter direction of the cross section of the base glass material, are covered with the high-viscosity glass material.

5. A producing method according to claim 1, wherein glass materials of plural kinds are employed as the high-viscosity glass material.

6. A method for producing a spacer having irregularities on a surface thereof by drawing a base glass material, having a cross sectional shape with different dimensions in vertical and lateral directions and having plural grooves on an external surface along a longitudinal direction of the cross section, under heating to a drawing temperature and then by cutting into a desired length, wherein:

the base glass material has a composite structure constituted of a low-viscosity glass material positioned in an internal layer of the base glass material and a high-viscosity glass material provided in an area including at least an external surface along the longitudinal direction of said cross section in a surface layer of the base glass material;

the high-viscosity glass material at least includes a member having plural grooves on an external surface side; and the base glass material is drawn under heating to a drawing temperature at which both the low-viscosity glass material and the high-viscosity glass material have a viscosity within a range of $10^5$ to $10^{10}$ dPa·s and the high-viscosity glass material has a viscosity higher than that of the low-viscosity glass material.

7. A producing method according to claim 6, wherein the low-viscosity glass material has a rectangular cross section and the high-viscosity glass material is applied on at least two surfaces in longer sides of the cross section of the low-viscosity glass material.

8. A producing method according to claim 7, wherein the high-viscosity glass material applied to the two surfaces in the longer sides of the cross section of the low-viscosity glass material include plural slat-shaped members, and said slat-shaped member has a width same as a pitch of said plural grooves and has two portions of different thicknesses corresponding to a peak portion and a bottom portion of said grooves.

9. A producing method according to claim 7, wherein the high-viscosity glass material, applied to the two surfaces at the longer sides of the cross section of the low-viscosity glass material, has a resistivity within a range of $10^8$ to $10^{10}$ Ω·cm.

10. A producing method according to claim 7, wherein the high-viscosity glass material is further applied to two surfaces in shorter sides of the cross section of the low-viscosity glass material.

11. A producing method according to claim 10, wherein the high-viscosity glass material applied to the two surfaces in the shorter sides of the cross section of the low-viscosity glass material, has a resistivity within a range of $10^3$ to $10^4$ Ω·cm.

12. A producing method according to claim 11, wherein glass materials of plural kinds are employed as the high-viscosity glass material.

* * * * *

UNITED STATES PATENT AND TRADEMARK OFFICE

CERTIFICATE OF CORRECTION

PATENT NO. : 7,052,354 B2
APPLICATION NO. : 10/630679
DATED : May 30, 2006
INVENTOR(S) : Kohei Nakata It is certified that error appears in the above-identified patent and that said Letters Patent is hereby corrected as shown below:

COLUMN 5

Line 46, “also” should be deleted.

COLUMN 7

Line 21, “may in a” should read --may be in a--.

COLUMN 9

Line 2, “case” should read --the case--; and
Line 56, “where” should read --wherein--.

COLUMN 10

Line 44, “may in a” should read --may be in a--.

COLUMN 11

Line 17, “according” should read --according to--.

COLUMN 12

Line 38, “consideration” should read --consideration of--; and
Line 48, “in case” should read --in a case wherein--.

COLUMN 13

Line 29, “shape” should read --the shape--;
Line 60, “shape” should read --the shape--; and
Line 61, “allows” should read --allow--.

UNITED STATES PATENT AND TRADEMARK OFFICE

CERTIFICATE OF CORRECTION

PATENT NO. : 7,052,354 B2
APPLICATION NO. : 10/630679
DATED : May 30, 2006
INVENTOR(S) : Kohei Nakata It is certified that error appears in the above-identified patent and that said Letters Patent is hereby corrected as shown below:

COLUMN 18

Line 26, “low viscosity” should read --low-viscosity--.

Signed and Sealed this

Twenty-sixth Day of December, 2006

JON W. DUDAS
*Director of the United States Patent and Trademark Office*